United States Patent [19]

Divine

[11] Patent Number: 4,867,187

[45] Date of Patent: Sep. 19, 1989

[54] UMBRELLA WITH REMOVABLE RADIO HANDLE

[75] Inventor: Joseph E. Divine, North Vancouver, Canada

[73] Assignee: Rainsinger Enterprises, Inc., North Vancouver, Canada

[21] Appl. No.: 171,660

[22] Filed: Mar. 22, 1988

[51] Int. Cl.[4] ..... A45B 23/00

[52] U.S. Cl. ..... 135/16; 135/66; 135/76

[58] Field of Search ..... 135/16, 66, 76, DIG. 10

[56] References Cited

U.S. PATENT DOCUMENTS

| | | | |
|---|---|---|---|
| 610,870 | 9/1898 | Quigley | 135/16 |
| 1,062,903 | 5/1913 | Forsheim et al. | 135/76 |
| 1,683,270 | 9/1928 | Taylor et al. . | |
| 1,707,473 | 4/1929 | Goldberg . | |
| 1,952,980 | 3/1934 | Fox | 135/76 |
| 2,117,373 | 5/1938 | Sobotka | 135/76 |
| 2,176,667 | 10/1939 | Crowley . | |
| 4,111,444 | 9/1978 | Clements | 135/66 X |
| 4,278,274 | 7/1981 | Ray | 135/66 X |
| 4,628,791 | 12/1986 | Phipps . | |

FOREIGN PATENT DOCUMENTS

| | | | |
|---|---|---|---|
| 964548 | 3/1975 | Canada | 135/76 |
| 1088152 | 3/1955 | France | 135/16 |
| 2477388 | 9/1981 | France | 135/DIG. 10 |
| 52-29348 | 3/1977 | Japan . | |
| 0664634 | 5/1979 | U.S.S.R. | 135/66 |
| 1144628 | 3/1969 | United Kingdom | 135/76 |

OTHER PUBLICATIONS

*Hong Kong Magazine,* "Singing in the Rain", Tradepower, Aug. 1981, p. 238.

*Popular Science,* "Sports Radio", Mar. 1940, pp. 214–215.

*Popular Mechanics,* "Transmitter in Nightstick, etc.", Feb. 1960, p. 171.

Potomac Magazine, "Schwartz Radio Hat", Washington Post, Dec. 1972, p. 71.

*Primary Examiner*—David A. Scherbel

*Assistant Examiner*—Anthony W. Williams

*Attorney, Agent, or Firm*—Wells, St. John & Roberts

[57] ABSTRACT

An umbrella includes a removable, longitudinally elongated handle which connects to the lower end of the shaft of the umbrella. The handle includes a battery powered radio receiver. A clip is provided for engaging the garment of the user enabling the handle to be independently worn and operated as a radio apart from the umbrella. A directional lamp is provided in one of the faces of the handle enabling the handle to function as a flashlight.

13 Claims, 2 Drawing Sheets

UMBRELLA WITH REMOVABLE RADIO HANDLE

TECHNICAL FIELD

This invention relates to umbrellas which incorporate radio receivers in their handles.

BACKGROUND OF THE INVENTION

The prior art has recognized the value of incorporating radio receivers within umbrella handles. For example, U.S. Pat. No. 1,683,270 to Taylor et al. discloses a radio receiver incorporated into the handle of an umbrella. Also, page 238 of the August 1981 Trade Power Catalogue discloses an umbrella having a solid-state radio built into the umbrella handle.

This invention includes improvements to these teachings.

BRIEF DESCRIPTION OF THE DRAWINGS

The preferred embodiment of the invention is illustrated in the accompanying drawings, in which.

DETAILED DESCRIPTION

Figure 1:
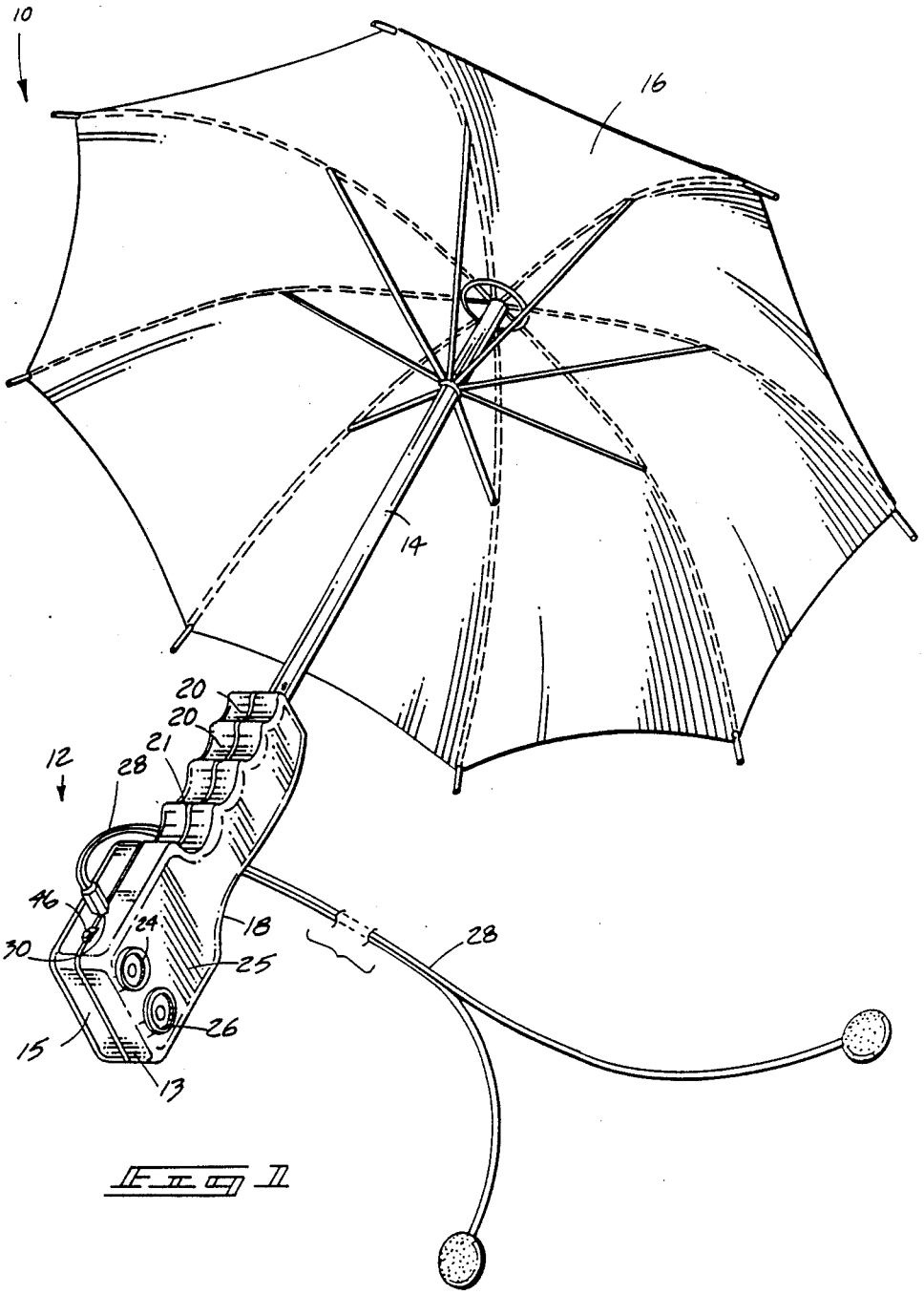
FIG. 1 is a perspective view of an umbrella and umbrella handle in accordance with the invention.
Figure 2:
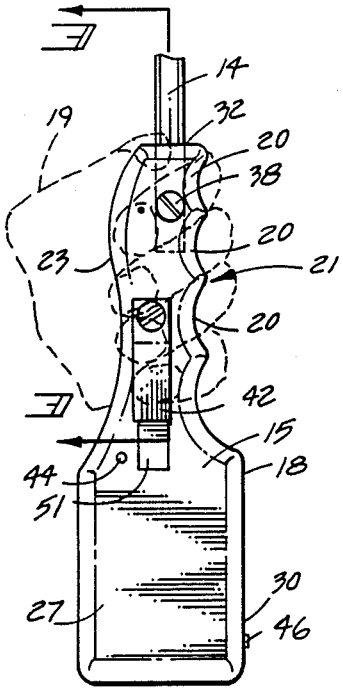
FIG. 2 is an enlarged back-side elevational view of the handle portion of the umbrella shown in FIG. 1.

The following disclosure of the invention is submitted in compliance with the constitutional purpose of the Patent Laws "to promote the progress of science and useful arts" (Article 1, Section 8).

A preferred embodiment of the invention is illustrated in FIGS. 1–4. In accordance with the invention, an umbrella 10 comprises a removable handle 12, a longitudinally elongated umbrella shaft 14 and a radially expandable canopy 16. Canopy 16 is connected to the first or upper end of shaft 14 while handle 12 operably engages the second or lower end of shaft 14.

Handle 12 is comprised of two interconnected halves 13, 15 which form an elongated handle body 14. The upper approximate one-half of body 18 includes a finger grip portion having separate finger troughs 20 formed along a defined handle front face 21. A handle rear face 23 is defined opposite front face 21. The upper portion of rear face 23 is rounded to comfortably accommodate the palm of a user's hand 19, with each of the user's fingers being received by one of the troughs 20 on front face 21. The finger grip portion defines a left handle face 25 and right handle face 27.

Figure 3:
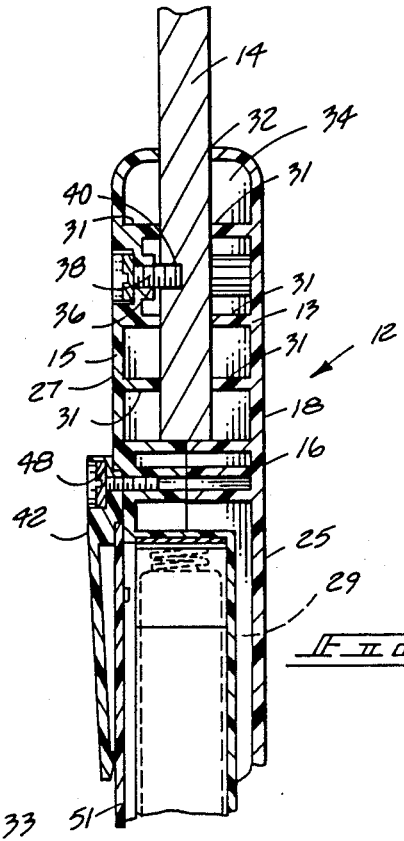
FIG. 3 is a further enlarged cross-sectional view taken along line 3—3 in FIG. 2.

The lower approximate one-half of body 18 is substantially rectangular in shape and houses the majority of the components of a battery powered radio receiver. For purposes of this disclosure, the term radio receiver is intended to include any device for receiving broadcast electric impulses by way of electric waves without a connecting wire and reconverting such impulses into at least audible sound. Examples would be conventional radio or television. In the illustrated embodiment, a conventional solid-state, transistor radio receiver is housed at the lower portion of handle body 18. FIG. 3 illustrates a battery 29 housed within body 18 for powering the radio and a flashlight lamp to be described subsequently. A tuner control 24 and adjacent on-off/volume control 26 are provided on handle face 25 adjacent the bottom thereof. Earphones 28 are also provided and connect to an earphone jack 30 at the lower portion of handle front face 21. Alternately, a speaker could be provided in the handle itself. Where a TV were employed, the TV screen would typically be positioned on one of right or left body faces 25, 27.

Handle body halves 13, 15 as connected form a top handle opening 32 which communicates with an internal handle receptacle 34. Opening 32 and receptacle 34 are sized for slidably and removably receiving the lower end of umbrella shaft 14. Each of body halves 13, 15 includes inwardly projecting ribs 31 which extend to engage umbrella shaft 14 to provide positive support. Releasable locking means in communication with receptacle 34 is provided for engaging umbrella shaft 14 to lock the handle and shaft to one another.

In the illustrated embodiment, the releasable locking means includes a laterally oriented threaded opening 36 which is formed in right face 27 of body half 15. Opening 36 is recessed from right face 27 and extends to receptacle 34. A bolt 38 is threadably received by opening 36. The lower or handle end of umbrella shaft 14 includes a laterally oriented opening 40 in its outer surface into which handle bolt 38 extends, either slidably or threadably. Alternately (not shown), a hole within umbrella shaft 14 need not be formed and bolt 38 would function as a set screw by bearing against shaft 14. Engagement of bolt 38 within a hole 40 formed in shaft 14 is preferred to provide more positive locking of handle 12 relative to shaft 14.

Figure 4:
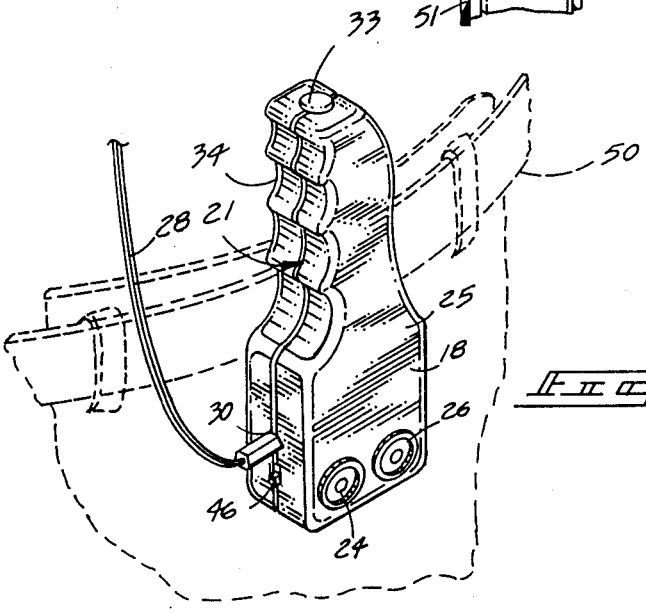
FIG. 4 is a perspective view of the handle portion of the umbrella shown as removed from the umbrella shaft and worn by a user.

A clip member 42 extends from right face 27 of handle 12 adjacent the finger grip portion. Clip 42 is secured to the handle by means of a bolt 48 which threads to body half 15. Removal of clip 42 by unthreading of bolt 48 exposes a removable battery compartment plate 51 for accessing battery 29. Clip 42 is adapted for engaging a portion of a garment worn by a user. This enables the handle with radio receiving means to be worn by a user when the umbrella shaft and handle are separated from one another. FIG. 4 illustrates handle 12 being clipped to a belt 50 of a user. Accordingly, the handle is able to function independently as a radio by the user apart from its function relative to an umbrella. For such, a removable plug 33 is provided for insertion into opening 32 to protect the opening from the elements.

In the illustrated embodiment, handle 12 is also configured to function as a flashlight. A focused or directional lamp 44 is positioned at the exterior of right handle face 27 just beneath and rearwardly of clip 42. It is operated by means of a switch 46 positioned beneath earphone jack 30 on front face 21. Battery 29 powers both lamp 44 and the radio receiver and amplifier.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefor, claimed in any of its forms or modifications within the proper scope of the appended claims, appropriately interpreted in accordance with the doctrine of equivalents.

I claim:

1. An umbrella comprising:

a longitudinally elongated umbrella shaft, a radially expandable canopy operably connected adjacent a first end of the shaft to shield a user of the umbrella from falling precipitation; and a handle comprising:

a longitudinally elongated body;

receptacle means at one end of the body for removably receiving the second end of the umbrella shaft;

releasable locking means in the receptacle means for selectively engaging the umbrella shaft to lock the handle and shaft relative to one another;

battery powered radio receiving means within the body for receiving broadcast electric impulses by way of electric waves without a connecting wire and reconverting such impulses into sound audible to a user;

a clip extending from an exterior portion of the body for engagement with a portion of a garment worn by a user to enable the handle with radio receiving means to be worn by a user apart from the umbrella; and a finger grip portion adjacent the one end of the body, the finger grip portion comprising separate troughs to retain the fingers of a user's hand.

2. The umbrella of claim 1 wherein the releasable locking means comprises a set screw on the handle body which engages against the umbrella shaft within the handle receptacle means.

3. The umbrella of claim 1 wherein, the umbrella shaft includes a laterally oriented opening in its outer surface adjacent its second end; and the releasable locking means comprises:

a laterally oriented threaded opening formed in the handle and in communication with the receptacle means; and a screw threadably received by the handle threaded opening and sized for engagement with the umbrella shaft opening.

4. The umbrella of claim 1 further comprising:

a battery powered illumination lamp positioned at an exterior portion of the handle, the lamp enabling the umbrella to function as a flashlight.

5. A handle for an umbrella comprising:

a longitudinally elongated body;

battery powered radio receiving means within the body for receiving broadcast electric impulses by way of electric waves without a connecting wire and reconverting such impulses into sound audible to a user;

receptacle means formed in one end of the body for removably receiving an end of an umbrella shaft;

releasable locking means in the receptacle means for selectively engaging an umbrella shaft while received within the receptacle means to enable the handle and shaft to be locked relative to one another;

a clip extending from an exterior portion of the body for engagement with a portion of a garment worn by a user to enable the handle with radio receiving means to be worn by a user apart from an umbrella; and a finger grip portion adjacent the one end of the body, the finger grip portion comprising separate troughs to retain the fingers of a user's hand.

6. The umbrella handle of claim 5 further comprising:

a battery powered illumination lamp positioned at the exterior of the body, the lamp enabling the handle to function as a flashlight.

7. The umbrella handle of claim 5 wherein the body is comprised of two interconnected halves that together form a top opening which communicates with the receptacle means for slidably and removably receiving the lower end of an umbrella shaft.

8. The umbrella handle of claim 5 wherein the body is comprised of two interconnected halves; and a removable plug complementary to the opening for insertion into the opening to protect the receptacle means from the elements.

9. The umbrella handle of claim 5 wherein the body is comprised of two interconnected halves that together form a top opening which communicates with the receptacle means for slidably and removably receiving the lower end of an umbrella shaft;

each body half including inwardly projecting ribs adapted to engage an umbrella shaft for providing positive support to it.

10. The umbrella handle of claim 5 wherein the body is comprised of two interconnected halves, an upper approximate one half of the body comprising the finger grip portion along a front handle face and further comprising a rear handle face rounded to comfortably accommodate the palm of a user's hand when the user's fingers are received by the troughs on the front handle face.

11. The umbrella handle of claim 5 wherein the body is comprised of two interconnected halves, an upper approximate one half of the body comprising the finger grip portion along a front handle face and further comprising a rear handle face rounded to comfortably accommodate the palm of a user's hand when the user's fingers are received by the troughs on the front handle face;

the lower approximate one-half of the body being substantially rectangular in shape and housing the majority of the components of the radio receiving means.

12. The umbrella handle of claim 5 wherein the body is comprised of two interconnected halves, an upper approximate one half of the body comprising the finger grip portion along a front handle face and further comprising a rear handle face rounded to comfortably accommodate the palm of a user's hand when the user's fingers are received by the troughs on the front handle face;

the lower approximate one-half of the body being substantially rectangular in shape and housing the majority of the components of the radio receiving means;

the width of the body between its front and rear handle faces being greater across its lower one half than across its upper one half.

13. The umbrella handle of claim 5 wherein the body is comprised of two interconnected halves, an upper approximate one half of the body comprising the finger grip portion along a front handle face and further comprising a rear handle face rounded to comfortably accommodate the palm of a user's hand when the user's fingers are received by the troughs on the front handle face;

the lower approximate one-half of the body being substantially rectangular in shape and housing the majority of the components of the radio receiving means;

the width of the body between its front and rear handle faces being greater across its lower one half than across its upper one half;

the exterior thickness of the upper and lower one halves across the front and rear handle faces being constant.

* * * * *